US007132795B2

(12) United States Patent
Kim et al.

(10) Patent No.: US 7,132,795 B2
(45) Date of Patent: Nov. 7, 2006

(54) PLASMA DISPLAY PANEL

(75) Inventors: Jung Hun Kim, Seoul (KR); Byoung Kuk Min, Seoul (KR)

(73) Assignee: LG Electronics Inc., Seoul (KR)

( * ) Notice: Subject to any disclaimer, the term of this patent is extended or adjusted under 35 U.S.C. 154(b) by 182 days.

(21) Appl. No.: 10/426,638

(22) Filed: May 1, 2003

(65) Prior Publication Data

US 2003/0209982 A1 Nov. 13, 2003

(30) Foreign Application Priority Data

May 9, 2002 (KR) ..... 10-2002-0025554
Sep. 11, 2002 (KR) ..... 10-2002-0054863
Sep. 11, 2002 (KR) ..... 10-2002-0054864

(51) Int. Cl.
*H01J 17/49* (2006.01)

(52) U.S. Cl. ..... 313/584; 313/585; 315/169.4

(58) Field of Classification Search ..... 313/582–586; 345/60, 71, 70; 315/169.4
See application file for complete search history.

(56) References Cited

U.S. PATENT DOCUMENTS 5,182,489 A * 1/1993 Sano ..... 313/485
6,242,859 B1 6/2001 Betsui et al. ..... 313/584
6,288,692 B1 * 9/2001 Kanazawa et al. ..... 345/67
6,344,080 B1 2/2002 Kim et al. ..... 106/287.23
6,420,830 B1 * 7/2002 Youn ..... 313/586
6,515,419 B1 * 2/2003 Lee et al. ..... 313/582
6,586,879 B1 * 7/2003 Shino et al. ..... 313/582
6,842,159 B1 * 1/2005 Kishi et al. ..... 345/60
2002/0024303 A1 * 2/2002 Sano et al. ..... 313/582
2002/0140341 A1 10/2002 Nishio

FOREIGN PATENT DOCUMENTS

| | | |
|---|---|---|
| CN | 1295313 | 5/2001 |
| JP | 05-266800 | 10/1993 |
| JP | 07-105856 | 4/1995 |
| JP | 08-315735 | 11/1996 |
| JP | 09 259768 A | 10/1997 |
| JP | 10-255664 | 9/1998 |
| JP | 10 308177 A | 11/1998 |
| JP | 11265661 | 9/1999 |
| JP | 2000 156167 A | 6/2000 |
| JP | 2001084915 | 3/2001 |

* cited by examiner

*Primary Examiner*—Ashok Patel
*Assistant Examiner*—Anthony Canning
(74) *Attorney, Agent, or Firm*—Fleshner & Kim, LLP

(57) ABSTRACT

A plasma display panel is disclosed which increases an aperture rate, facilitate alignment, makes a cell to be shown uniformly, minimizes an increase in capacitance and a reduction of a cell size, and shares a metal bus electrode. The plasma display panel includes: a plurality of discharge cells and a metal bus electrode formed at an upper portion of a barrier rib formed to divide the plurality of discharge cells.

17 Claims, 6 Drawing Sheets

G1 > G2

G1 > G2

PLASMA DISPLAY PANEL

BACKGROUND OF THE INVENTION

1. Field of the Invention

The present invention relates to a plasma display panel and, more particularly, to a plasma display panel that is capable of increasing an aperture ratio and facilitating alignment.

2. Description of the Background Art

In general, a plasma display panel (PDP) displays an image including a character or a graphic by allowing light to be emitted from a phosphor by a vacuum ultra violet (VUV) of 147 nm which is generated when a gas such as He+X3, N3+X3, H3+Ne+Xe is discharged. With its advantage of being easily thin and large, the PDP attracts much attention as a large-scale flat panel display.

FIGS. 1A and 1B show the structure of a 3-electrode alternating current (Ac) type PDP in accordance with a conventional art.

As illustrated, the PDP includes a lower glass substrate 1; an address electrode 2 formed on a certain portion of the lower glass substrate 1; a lower dielectric layer 9 formed at the entire surface of the lower glass substrate 1 and of the address electrode 2; a barrier rib 3 defined at a certain portion on the lower dielectric layer 9 to divide a plurality of discharging cells; a fluorescent layer 8 formed with a certain thickness on the barrier rib 3 and emitting visible rays of red, green and blue upon receiving an ultraviolet ray; an upper glass substrate 7; a scan electrode 6-1 and a sustain electrode 6-2 formed at a certain portion of the upper glass substrate 7 and intersecting the address electrode 2 in a vertical direction; an upper dielectric layer 5 formed at an entire surface of the scan electrode 6-1, the sustain electrode 6-2 and the upper glass substrate 2; and a passivation layer 4 formed on the upper dielectric layer 5 to protect it.

The scan electrode 6-1 consists of a transparent electrode 6-1A formed at a certain portion of the upper glass substrate 2; and a metal bus electrode 6-1B formed at a certain portion of the transparent electrode 6-1A.

The sustain electrode 6-2 consists of a transparent electrode 6-2A formed on a certain portion of the upper glass substrate 2; and a metal bus electrode 6-2B formed at a certain portion on the transparent electrode 6-2A.

The scan electrode 6-1 and the sustain electrode 6-2 are called a pair of sustain electrodes 6-1 and 6-2, and the metal bus electrodes 6-1B and 6-2B of the scan electrode 6-1 and the sustain electrode 6-2 are installed in a discharge space of one cell.

The operation of the conventional plasma display panel will now be described.

First, the upper glass substrate 7 and the lower glass substrate 1 are disposed in parallel with a certain space therebetween. A mixed gas is injected to a discharge space between the upper and lower glass substrate 1 and 7. When the mixed gas is discharged, the fluorescent layer 8 is coated on the barrier rib 3.

On the upper glass substrate 7, the upper dielectric layer 5 and the passivation layer 4 are sequentially stacked. The pair of sustain electrodes 6-1 and 6-2 consisting of the metal bus electrodes 6-1B and 6-2B and the transparent electrodes 6-1A and 6-2A are formed side by side between the upper glass substrate 7 and the upper dielectric layer 5 in a perpendicular direction to the address electrode 2.

The transparent electrodes 6-1A and 6-2A are formed on the upper glass substrate 7, and the metal bus electrodes 6-1B and 6-2B are formed on a certain portion of the transparent electrodes 6-1A and 6-2A.

The address electrode 2 is formed on the lower glass substrate 1, and the lower dielectric layer 9 is stacked at the entire surface of the lower glass layer 1 and the address electrode 2. The barrier ribs 3 are formed with the address electrode 2 therebetween on the lower dielectric layer 9.

The barrier rib 3 formed on the lower dielectric layer 9 cuts off an electric and optical interference between cells and is formed between the upper and lower glass substrates 1 and 7 to form a discharge space inside the cell.

The fluorescent layer 8 coated on the barrier rib 3 is excited by a vacuum ultraviolet with a short wavelength generated when a gas is discharged in the discharge space and generates three color visible rays. Accordingly, red, green and blue lights, three primary colors, are emitted from each cell.

The upper and lower dielectric layers 5 and 9 serve to store electric charges when the gas is discharged. The passivation layer 5 serves to protect the upper dielectric layer 5 against a sputtering phenomenon of plasma particles, and is mainly made of magnesium oxide (MgO).

Following the address discharge, discharge is sustained in the pair of sustain electrodes 6-1 and 6-2 as a voltage is applied thereto to cause the discharging. The transparent electrodes 6-1A and 6-2A of the pair of sustain electrodes 6-1 and 6-2 are made of a transparent conductive material with a light transmittance of above 90% (i.e., Indium-Tin-Oxide (ITO)) and pass through most of visible rays emitted from the fluorescent layer 8. However, in spite of the high light transmittance, such a substance as ITO has a low conductivity and thus has a very high resistance value, failing to efficiently transmit power. In order to solve this problem, the metal bus electrodes 6-1B and 6-2B made of a material with a high conductivity such as Ag or Cu are installed on the transparent electrode 6A. By doing that, the metal bus electrodes 6-1B and 6-2B lower down a resistance value of the pair of sustain electrodes 6-1 and 6-2 and prevent a voltage drop caused due to a high resistance of the transparent electrodes 6-1A and 6-2A.

The U.S. Pat. No. 5,838,106 registered on Nov. 17, 1998, the U.S. Pat. No. 6,242,859 registered on Jun. 5, 2001 and the U.S. Pat. No. 6,344,080 registered on Feb. 5, 2002 disclose plasma display panels and their fabrication methods.

However, the conventional PDP has a problem that since the metal bus electrodes 6-1B an 6-2B are formed at an upper portion of the discharge space of one cell, a portion of the visible ray emitted in the discharge space is interrupted, which deteriorates a luminance and efficiency of the PDP.

In addition, forming the metal bus electrodes 6-1B and 6-2B at the upper portion of the discharge space of one cell also causes a problem of reduction of an aperture ratio.

SUMMARY OF THE INVENTION

Therefore, an object of the present invention is to provide a plasma display panel that is capable of increasing an aperture ratio and facilitating alignment.

Another object of the present invention is to provide a plasma display panel that is capable of improving an aperture ratio by employing a lattice type barrier rib.

Still another object of the present invention is to provide a plasma display panel that is capable of making cells to be shown uniformly, increasing a capacitance of the cell, minimizing reduction of the cell size, and sharing a metal bus electrode.

To achieve these and other advantages and in accordance with the purpose of the present invention, as embodied and broadly described herein, there is provided a plasma display panel including: a plurality of discharge cells; and metal bus electrodes formed at an upper portion of barrier ribs formed to divide the plurality of discharge cells.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Plasma display panels in accordance with preferred embodiments of the present invention are capable of increasing an aperture ratio, facilitating alignment, forming cells uniformly, increasing a capacitance of the cell; minimizing reduction of a cell size, and sharing a metal bus electrode by forming the metal bus electrodes at an upper portion of barrier ribs formed to divide a plurality of discharge cells, which will now be described with reference to FIGS. 2 to 9.

First Embodiment

Figure 1A:
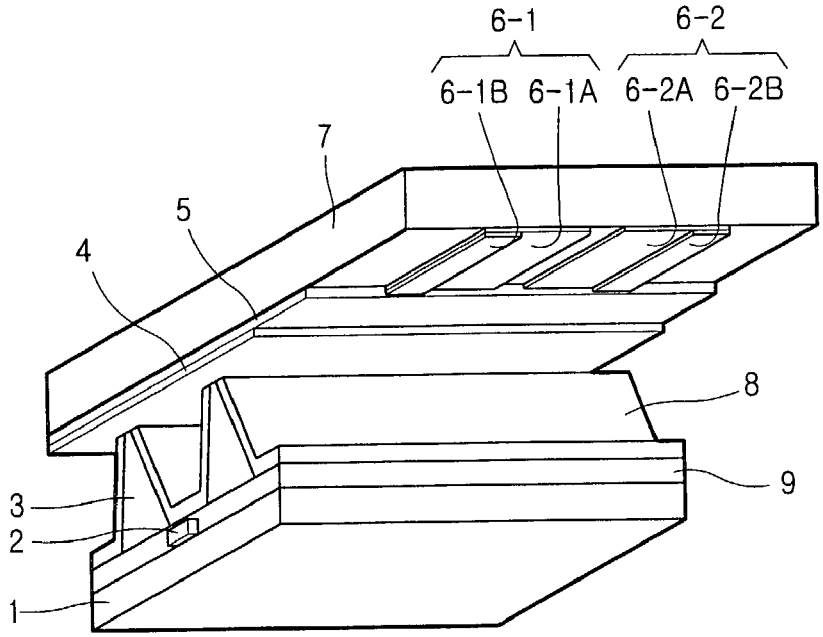
FIG. 1A CONVENTIONAL ART
FIGS. 1A and 1B show the structure of a three alternating current (AC) type PDP in accordance with a conventional art.
Figure 1B:
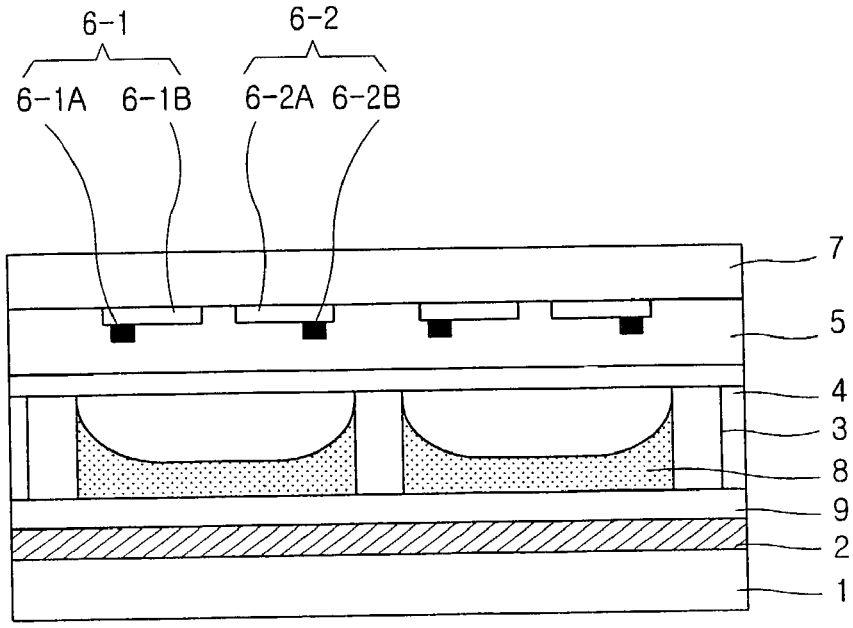
FIG. 1B CONVENTIONAL ART
Figure 2:
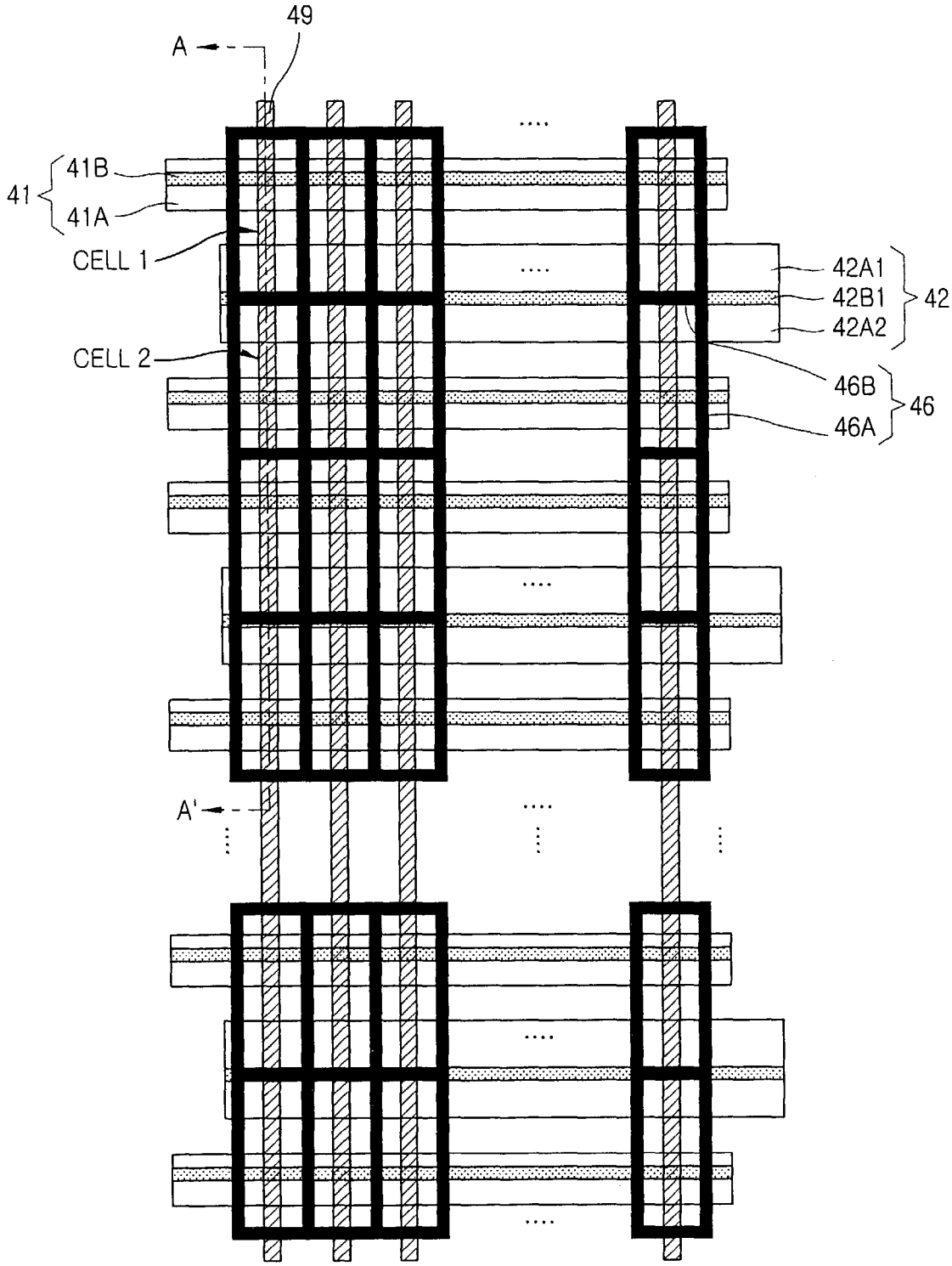
FIG. 2 is a plan view showing the structure of a plasma display panel (PDP) in accordance with a first embodiment of the present invention.
Figure 3:
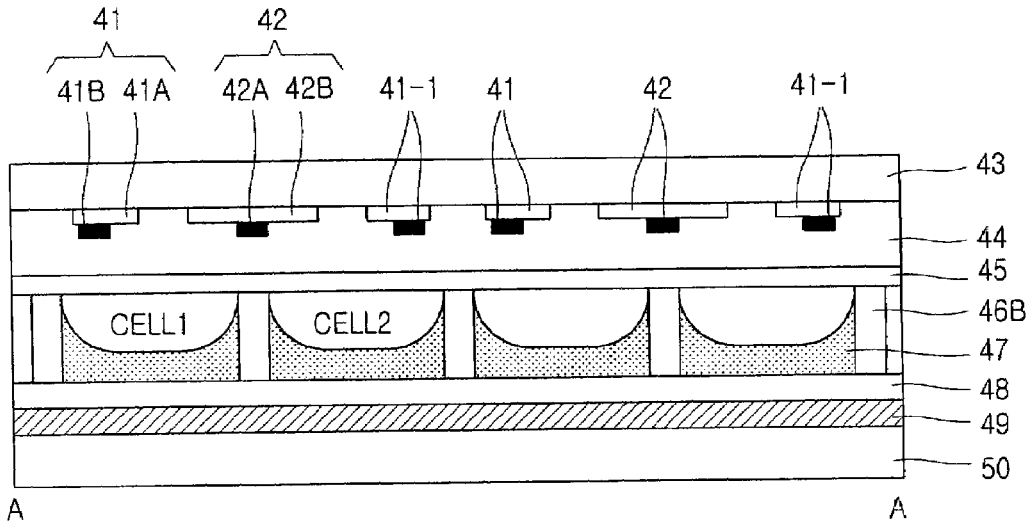
FIG. 3 is a sectional view showing the PDP taken along line A–A' of FIG. 2.

FIG. 2 is a plan view showing the structure of a plasma display panel (PDP) in accordance with a first embodiment of the present invention, and FIG. 3 is a sectional view showing the PDP taken along line A–A' of FIG. 2.

As shown in FIG. 3, a PDP in accordance with a first embodiment of the present invention includes: a lower glass substrate 50; an address electrode 49 formed on the lower glass substrate 50; a lower dielectric layer 48 formed on the address electrode 49; a barrier rib 46B defined at a certain portion on the lower dielectric layer 48 to divide a plurality of discharge cells; a fluorescent layer 47 formed with a certain thickness on the side of the barrier rib 46*b* and on the lower dielectric layer 48 exposed between the barrier ribs 46B and emitting red, green and blue visible ray upon receiving an ultraviolet ray; an upper glass substrate 43; a scan electrode 41 and a common sustain electrode 42 formed at certain portions on the upper glass substrate 43 and intersecting the address electrode 49 perpendicularly; an upper dielectric layer 44 formed entirely on the scan electrode 41, the common sustain electrode 42, and the upper glass substrate 43; and a passivation layer 45 formed on the upper dielectric layer 44 in order to protect it.

The scan electrode 41 consists of a transparent electrode 41A formed at a certain portion on the upper glass substrate 43 and intersecting the address electrode 49 perpendicularly; and a bus electrode (metal bus electrode) 41B formed at a certain portion on the transparent electrode 41A.

The common sustain electrode 42 is a sustain electrode commonly used by two adjacent discharge cells and consists of a transparent electrode 42A formed at a certain portion on the upper glass substrate 43 and intersecting the address electrode 49 perpendicularly and a bus electrode 42B formed at a certain portion on the transparent electrode 42A. The transparent electrode 42A commonly used with an adjacent cell is formed on the barrier rib 46B, and the bus electrode 42B of the common sustain electrode 42 is formed in a direction that it corresponds to the barrier rib 46B and formed along the central portion of the transparent electrode 42A.

The electrode and barrier rib structure of the plasma display panel in accordance with the present invention will now be described in detail.

First, the mutually adjacent discharge cells (cell 1 and cell 2) in the PDP share the bus electrode 42B of the common sustain electrode 42. That is, each of the discharge cells (cell 1 and cell 2) has the scan electrode 41 and the common sustain electrode 42 formed on the upper glass substrate and the address electrode 49 formed on the lower glass substrate 50. The scan electrode 41 consists of the transparent electrode 41A and the bus electrode 41B formed on the transparent electrode 41A. The common sustain electrode 42 consists of the transparent electrode 42A and the bus electrode 42B formed on the transparent electrode 42A. The scan electrode and the common sustain electrode 42 are called a pair of sustain electrodes.

The transparent electrodes 41A and 42A are formed of indium tin oxide, a transparent conductive material, and the bus electrodes 41B and 42B are formed of a metal material such as chrome (Cr) to compensate a resistance component of the transparent electrodes 41A and 42A.

The upper dielectric layer 44 and the passivation layer 45 are sequentially formed on the upper glass substrate 43 on the upper glass substrate 43 with the pair of the sustain electrodes 41 and 42 formed thereon. A wall charge is stored on the upper dielectric layer 44 as being generated when plasma is discharged. The passivation layer 45 prevents the upper dielectric layer 44 from being damaged by a sputtering phenomenon and heightens a discharge efficiency of a secondary electron. The passivation layer 45 is made of magnesium oxide (MgO).

The lower dielectric layer 48 is formed on the address electrode 49 to store the wall charge. A well type barrier rib 46 is formed on the lower dielectric layer 48. The barrier rib 46 consists of a first barrier rib 46A formed in the unit of line of pixel and a second barrier rib 46B formed in the unit of column of pixel to insect the first barrier rib, 46A and formed corresponding to the bus electrode 42B.

The fluorescent layer 47 is coated on the lower dielectric layer 48 and on the surface of the well type barrier rib 46B. The well type barrier rib 46B cuts off an ultraviolet ray or visible ray generated in the discharge space so that they may not be leaked to the adjacent discharge cells. The fluorescent layer 47 is excited by the ultraviolet ray generated when plasma is discharged, and generates one of red, green and blue visible rays. An inert gas is injected into the discharge space between the lower glass substrate 50 and the barrier rib 46B, for gas discharging.

The well type barrier rib 46 in accordance with the first embodiment of the present invention consists of the first barrier rib 46A formed perpendicular to the pair of sustain electrodes 41 and 42 and the second barrier rib 46B formed intersecting the first barrier rib 46A.

The discharge cells (cell 1 and cell 2) are placed adjacent with the bus electrode 42B corresponding to the second barrier rib 46B of the well type barrier rib 46 therebetween. That is, the first discharge cell (cell 1) having the first scan electrode 41 is adjacent to the second discharge cell (cell 2) having the second scan electrode 41-1 with the bus electrode 42B of the first common sustain electrode 42 therebetween. Namely, the (k+1)/2th common sustain electrode ((k+1)/2)) is formed between the kth scan electrode of the kth discharge cell (k is an odd number above '1') and the (k+1)th scan electrode (K+1) of the (k+1)th discharge cell (k+1).

The shared bus electrode 42B of the common sustain electrode 42 is formed at a certain portion of the transparent electrode 42A. A first side surface 46A1 of the transparent electrode 42A formed facing the kth scan electrode and a second side surface 42A2 of the transparent electrode 42A is formed facing the (K+1)th scan electrode (k+1). The width of the scan electrode 41 is the same as the width of the first or the second side surface 42A1 or 42A2 of the transparent electrode 42A of the common sustain electrode 42. In case a XgA class (1365×768 mm) of PDP, the width of the shared bus electrode 42B is preferably about 70 μm. That is, the width of the transparent electrode 41A is the half of the width of the transparent electrode 42A.

Meanwhile, the structure of the transparent electrodes 41A and 42A can be modified to various forms, which will now be described with reference to FIG. 4.

Figure 4:
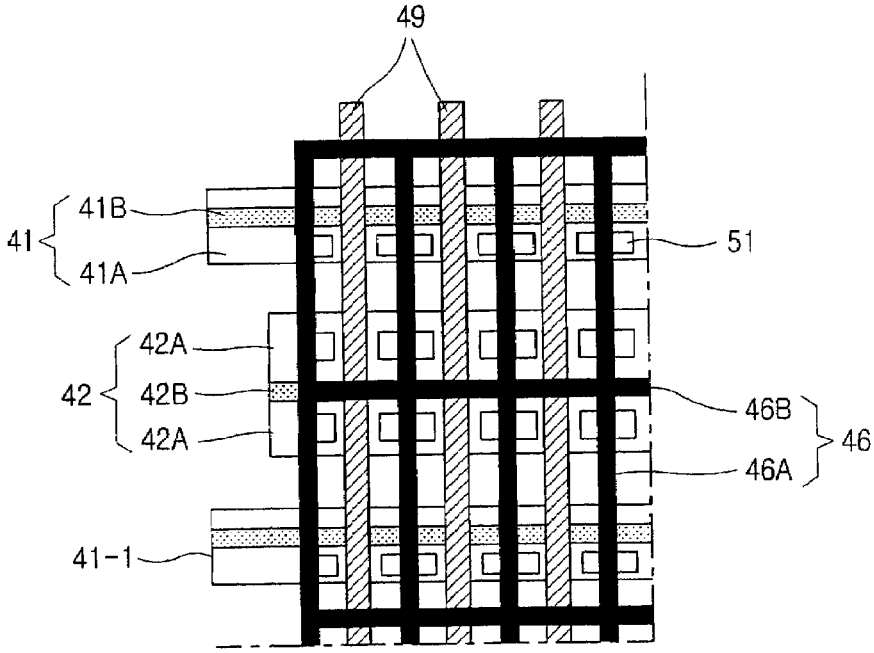
FIG. 4 is a plan view showing a different type of transparent electrode of FIGS. 2 and 3.

FIG. 4 is a plan view showing a different type of transparent electrode of FIGS. 2 and 3.

As shown in FIG. 4, a recess 51 is formed on the transparent electrodes 41A and 42A so that a surface area can be relatively reduced compared to the transparent electrode as shown in FIG. 3 and thus a power consumption can be reduced. Accordingly, since the mutually adjacent discharge cells (cell 1 and cell 2) share the bus electrode 42B of the common sustain electrode 42, a certain voltage can be applied to one common sustain electrode 42 formed in the mutually adjacent discharge cells (cell 1 and cell 2). However, since the two scan electrodes 41 and 41-1 formed in the mutually adjacent discharge cells (cell 1 and cell 2) exist independently, they can have a different scan time.

That is, after the common sustain electrode 42 is selected by a double substrate two electrode discharge between the kth address electrode and the kth sustain electrode, discharge is sustained by the surface discharge between the pair of sustain electrodes (Yk, (k+1)/2).

And then, after the common sustain electrode 42 is selected by a double substrate two electrode discharge between the kth address electrode and the (k+1)th scan electrode, a discharging is sustained by the surface discharge between the pair of sustain electrodes ((k+1), (k+1)/2).

In the discharge cell, light is emitted from the fluorescent layer 47 by the ultraviolet ray generated in the sustain discharge, so that the visible ray is emitted outwardly of the cell. Accordingly, the period of discharge sustain of the discharge cells is controlled to implement a contrast, and the PDP with the discharge cells arranged in a matrix form displays an image.

In this manner, in the PDP in accordance with the present invention, the mutually adjacent discharge cells share one common sustain electrode 42. That is, if M number of scan electrodes 41 are formed, M/2 number of common sustain electrodes are formed. Since the number of output terminals of pads (not shown) connected to the M/2 number of common sustain electrodes 42 is reduced to half, its alignment is easy.

In addition, since one bus electrode 42B is formed on the well type barrier rib 46B, unlike in the conventional art in which two bus electrodes are formed intersecting one discharge cell, the bus electrodes are reduced from two to one. Therefore, an aperture ratio is relatively increased, so that a luminance and an efficiency of the PDP are increased and a crosstalk phenomenon is reduced.

Second Embodiment

Figure 5:
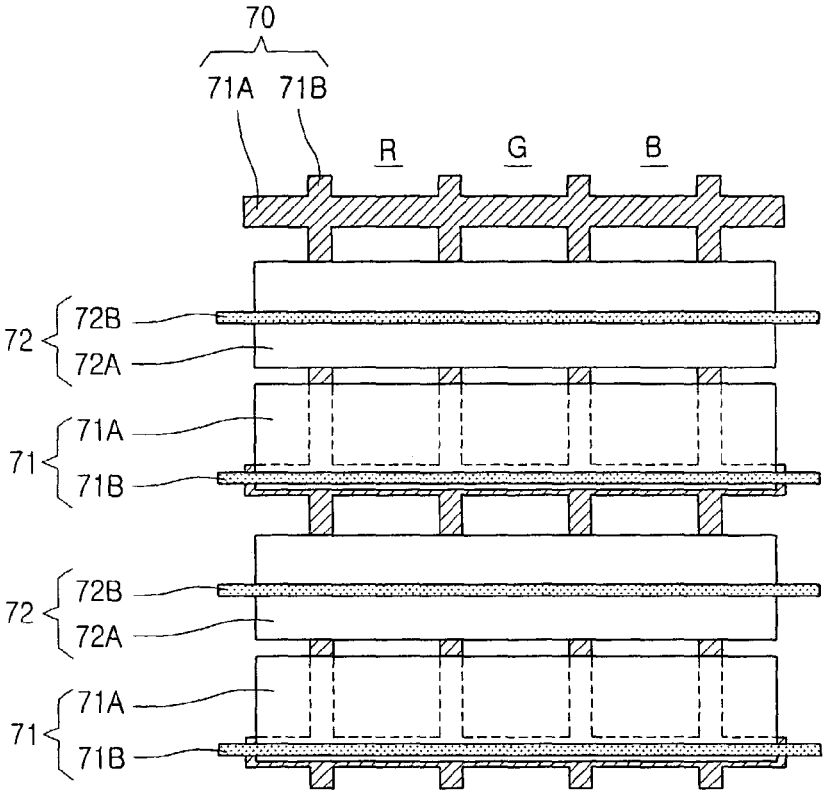
FIG. 5 is a plan view showing the structure of a PDP in accordance with a second embodiment of the present invention.

FIG. 5 is a plan view showing the structure of a PDP in accordance with a second embodiment of the present invention. That is, FIG. 5 is a plan view showing a structure of the pair of sustain electrodes and the barrier rib structure in the plasma display panel. The PDP in accordance with the second embodiment of the present invention has the same construction as that of FIG. 3, except for electrodes and barrier ribs, descriptions of which are thus omitted.

As shown in FIG. 5, the PDP in accordance with the second embodiment of the present invention consists of a scan electrode 71 positioned at a central portion of each cell and sustain electrode 72 overlapped at horizontal barrier ribs 70A.

The scan electrode 71 consists of a transparent electrode 71A formed on the upper glass substrate 43, and a bus electrode 71B formed at a certain portion on the transparent electrode 71A.

The sustain electrode 72 consists of a transparent electrode 72A formed on the upper glass substrate 43 and a bus electrode 72B formed at a certain portion on the transparent electrode 72A and overlapped at an upper portion of the horizontal barrier rib 70A.

A scan signal for panel scanning and a sustain signal for discharge sustaining are supplied to the scan electrode 71 of the pair of sustain electrodes 71 and 72, and a sustain signal for sustaining discharge is supplied to the sustain electrode 72 (which signifies the common sustain electrode 42).

The bus electrode 71B of the scan electrode 71 is positioned at a certain portion of the cell, and the bus electrode 72B of the sustain electrode 72 is positioned corresponding to one side of the barrier rib 70B of the cell. The bus electrodes 71B and 72B are made of a metal material with a high conductivity, that is, silver (Ag) or copper (Cu). Transparent electrodes 71A and 72A of each of the pair of the sustain electrodes 71 and 72 are formed facing each other in the cell region.

A barrier rib 70 formed to section the cell region consists of a horizontal barrier rib formed in a horizontal direction and a vertical barrier rib 70B formed in a vertical direction. As the horizontal barrier rib 70A and the vertical barrier rib 70B intersect each other, each cell is encompassed by barrier ribs. That is, The PDP in accordance with the second embodiment of the present invention includes the pair of sustain electrodes 71 and 72 with a modified pattern from the conventional PDP. Therefore, the PDP in accordance with the second embodiment of the present invention can be fabricated according to the conventional fabrication process by simply correcting a conventional mask pattern for fabricating a pair of sustain electrodes without any additional process.

The structure of the pair of sustain electrodes and the barrier rib structure in the PDP as shown in FIG. 5 will now be described in detail with reference to FIG. 6.

Figure 6:
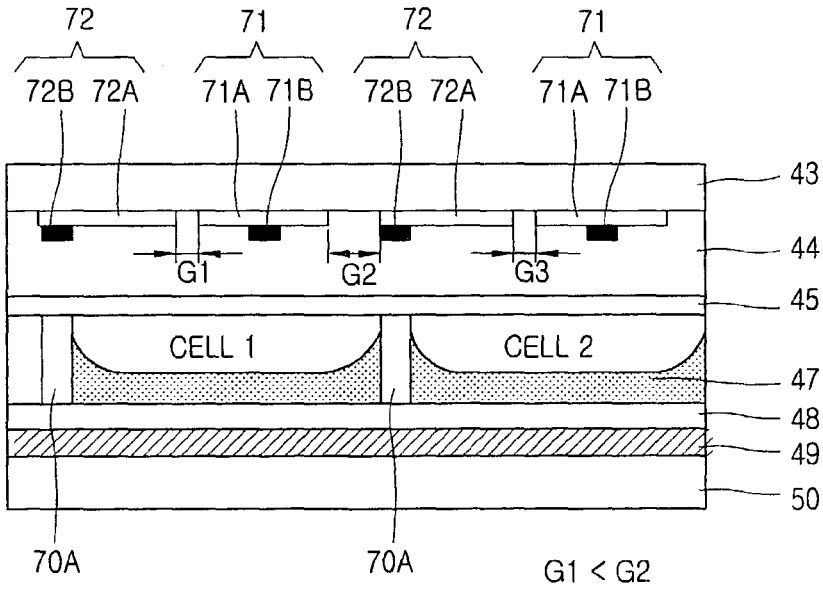
FIG. 6 is a sectional view showing the structure of the PDP of FIG. 5.

FIG. 6 is a sectional view showing the structure of the PDP of FIG. 5.

As shown in FIG. 6, the bus electrode 72B of the sustain electrode 72 employed for the PDP in accordance with the second embodiment of the present invention is overlapped at the horizontal barrier rib 70A, and the bus electrode 71B of the scan electrode 71 is positioned at the central portion of the cell. That is, only one bus electrode 71B having a metal component to lower a light transmittance is positioned in one cell.

For instance, comparatively, in the conventional PDP, two bus electrodes are formed in one cell region and a portion of the visible ray emitted in the discharge space of one cell region is interrupted by the two bus electrodes.

Meanwhile, in the PDP in accordance with the second embodiment of the present invention, since one bus electrode is formed in one cell region, more amount of visible ray than in the conventional art can be emitted to an image display region. Namely, the amount of visible ray emitted in the discharge space of one cell region to the image display region can be increased.

Accordingly, the PDP in accordance with the second embodiment of the present invention has improved luminance characteristics. In addition, since the luminance characteristics is improved even with the same power consumption as that of the conventional PDP, efficiency characteristics can be thus improved.

In the PDP in accordance with the second embodiment of the present invention, besides the main discharging between the pair of sustain electrodes 71 and 72 occurring in one cell, a mis-discharge between a scan electrode 71 of one cell and a sustain electrode 72 of its adjacent cell can occur at a marginal portion of adjacent cells according to arrangement of electrodes. Thus, in order to prevent such a mis-discharge, a gap (G2) between the scan electrode 71 of one cell and the sustain electrode 72 of the adjacent cell should be wider than a gap (G1) between the pair of sustain electrodes 71 and 72 of one cell. That is, the interval of G2 is preferably 1.5 times or twice G1.

The transparent electrode 72A of the sustain electrode 72 is partially overlapped with the horizontal barrier rib 70A and formed not so as to be formed in an adjacent cell. Meanwhile, the bus electrode 72B of the sustain electrode 72 is formed to correspond only to one upper portion of the horizontal barrier rib 70A.

When a driving voltage is applied to the PDP, a high electric field is generated in the vicinity of the bus electrodes 71B and 72B. Thus, the bus electrode 71B of the scan electrode 71 is formed inclined to the center of the cell. That is, by disposing the bus electrode 71B of the scan electrode 71 to be close to the center of one cell, the bus electrode 71B is distanced from the bus electrode 72B of the adjacent cell, and accordingly, a probability of occurrence of mis-charge can be reduced. In addition, forming the bus electrode 71B of the scan electrode 71 to be inclined to the center of one cell facilitates formation of the wall charge on the barrier rib when the address electrode 49 is discharged, and accordingly, an address voltage, a driving voltage, applied to the address electrode 49 can be lowered down.

Moreover, when the discharge cells are viewed from a distance, each cell is viewed symmetrically thanks to the bus electrode 71B of the scan electrode 71 formed at the central portion of the cell, preventing a phenomenon that two cells are shown as one cell like in the conventional PDP employing the common sustain electrode. Thus, visual characteristics of the panel of the PDP in accordance with the second embodiment of the present invention is much improved.

As a result, the PDP in accordance with the second embodiment of the present invention has the following advantages.

That is, first, since the bus electrode 72B of the sustain electrode 72 is formed to correspond to the upper portion of the horizontal barrier rib 70A and the bus electrode 71B of the scan electrode 71 is formed to be positioned at the central portion of the cell, the number of bus electrodes positioned in one cell can be reduced.

Secondly, with the reduced number of bus electrodes positioned in one cell, luminance and efficiency characteristics of the PDP can be improved.

Lastly, the phenomenon that an image is unevenly displayed because two adjacent cells are shown as one cell can be prevented.

Third Embodiment

Figure 7:
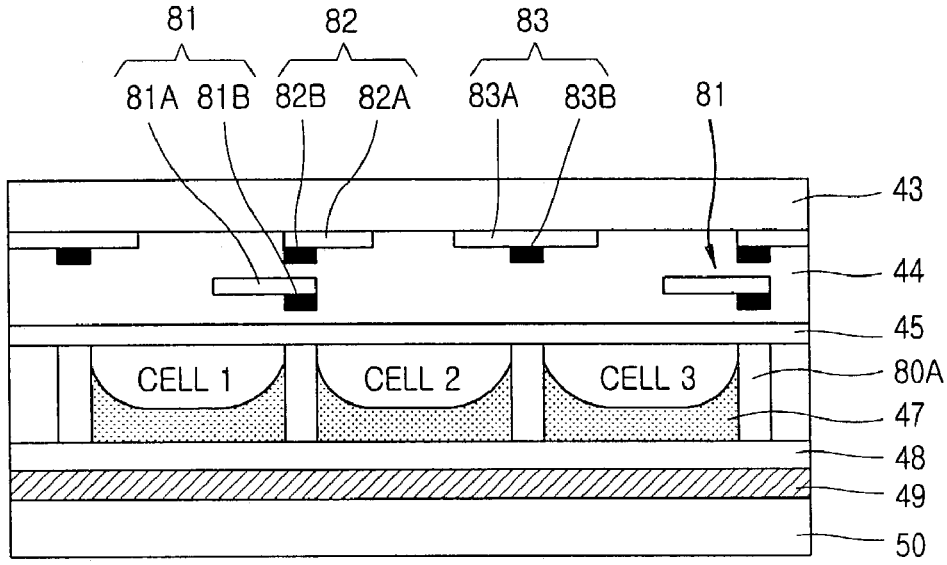
FIG. 7 is a sectional view showing the structure of a PDP in accordance with a third embodiment of the present invention.

FIG. 7 is a sectional view showing the structure of a PDP in accordance with a third embodiment of the present invention. Specifically, FIG. 7 shows a structure of a pair of sustain electrodes and a barrier rib structure of a plasma display panel.

The PDP in accordance with the third embodiment of the present invention includes a pair of sustain electrodes 81~83 with a modified pattern from the conventional PDP and thus can be fabricated according to the conventional fabrication process by simply correcting a mask pattern for fabricating a pair of sustain electrodes without any additional process.

As shown in FIG. 7, the PDP includes: a scan electrode 82 formed on the upper glass substrate 43 and formed to correspond to an upper portion of a horizontal barrier rib 80A; a scan electrode 81 formed such that a portion thereof is overlapped with a lower portion of the scan electrode 82; and a common sustain electrode 83 formed on the upper glass substrate 43 and formed to correspond to the upper portion of the horizontal barrier rib 80A.

The scan electrode 82 consists of a transparent electrode 82A formed on the upper glass substrate 43 and a bus electrode 82B formed at a certain portion on the transparent electrode 82A.

The sustain electrode 83 consists of a transparent electrode 83A formed on the upper glass substrate 43 and a bus electrode 83B formed at a certain portion on the transparent electrode 83A and overlapped at an upper portion of the horizontal barrier rib 80A.

The scan electrode 81, formed such that a portion thereof is overlapped at the lower portion of the scan electrode 82, consists of a transparent electrode 81A formed between an upper portion of the barrier rib 80A and a lower portion of the scan electrode 82 and a bus electrode 81B formed at a certain portion on the transparent electrode 81A.

That is, in the PDP in accordance with the third embodiment, the bus electrodes 81B, 82B and 83B are not formed in a discharge space of one cell but positioned at an upper portion of the barrier rib 80A formed between cells.

A scan signal for panel scanning to select horizontal lines formed by a plurality of horizontally adjacent cells and a sustain signal for sustaining discharge are supplied to the scan electrode 82 of the pair of sustain electrodes 82 and 83.

A sustain signal is supplied to the common sustain electrode 83 to sustain the discharge of a selected horizontal line.

The bus electrodes 82B and 83B of the pair of sustain electrodes 82 and 83 are positioned at both marginal portions of a cell, that is, at an upper portion of the barrier rib 80A and formed of a metal material with a high conductivity, such as silver (Ag) or copper (Cu). The pair of transparent electrodes 82A and 83A of the pair of sustain electrodes 82 and 83 are formed facing each other in the cell region.

The barrier ribs in the lattice type formed to section the cell regions include a horizontal barrier rib 80A formed in a horizontal direction and a vertical barrier rib (not shown) formed in a vertical direction, and as the horizontal barrier rib 80A and the vertical barrier rib 80B are formed intersecting each other, each cell is encompassed by the barrier ribs.

That is, in the PDP in accordance with the third embodiment of the present invention, the common sustain electrode 83 and the overlapped scan electrodes 81 and 82 are employed so that all the metal bus electrodes 82B and 83B of the pair of sustain electrodes are overlapped at the upper portion of the horizontal barrier rib 80A. Accordingly, only the transparent electrodes 81A, 82A and 83A with an excellent light transmittance are positioned in one cell.

For instance, in the conventional PDP, two bus electrodes are formed in one cell region and a portion of visible ray emitted in the discharge space of one cell region is interrupted by the two bus electrodes.

In comparison, however, in the PDP in accordance with the third embodiment of the present invention, the bus electrode is not formed in one cell region but formed at the upper portion of the barrier rib, so that more visible ray than in the conventional PDP can be emitted to the image display region. That is, the amount of visible ray emitted in the discharge space of one cell region to the image display region can be increased.

The PDP in accordance with the third embodiment of the present invention has the following advantages.

That is, first, it has improved luminance characteristics. Especially, the PDP in accordance with the third embodiment of the present invention has such improved luminance characteristics for the same power consumption as that of the conventional art. Thus, it accomplishes efficiency characteristics improvement.

Second, by employing the common sustain electrode like in the conventional art and forming the scan electrodes 81 and 82 as being overlapped, such shortcomings that two adjacent cells are shown as one cell as in the conventional PDP which employs a pair of common sustain electrodes can be gotten rid of even without forming the barrier rib thick. In other words, compared to the conventional PDP in which horizontal barrier ribs are all formed thick, the horizontal barrier rib 80A in the PDP of the present invention does not need to be thick, so that an effective volume of a cell is not reduced and the cell is shown uniform. Therefore, in the PDP in accordance with the third embodiment of the present invention, the horizontal barrier rib 80A adjacent to the scan electrode 82 and the common sustain electrode 83 are formed with a minimum thickness as required, so that an increase in capacitance between the scan electrode 81 and the common sustain electrode 83 can be minimized.

Lastly, by forming the bus electrodes 82B and 83B of the scan electrode 82 and the common sustain electrode 83 to be overlapped at the upper portion of the horizontal barrier rib 80A, the phenomenon that cells are shown uneven is prevented, thereby improving a display quality of the PDP and minimizing an increase in the capacitance and a reduction of the cell size.

Fourth Embodiment

Figure 8:
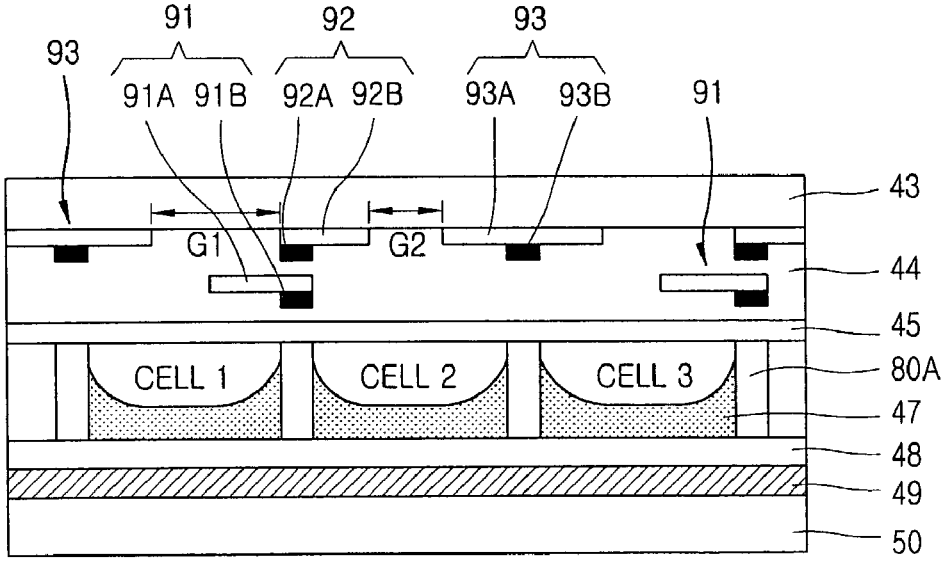
FIG. 8 is a sectional view showing the structure of a PDP in accordance with a fourth embodiment of the present invention.

FIG. 8 is a sectional view showing the structure of a PDP in accordance with a fourth embodiment of the present invention. Specifically, FIG. 8 shows a structure of a pair of sustain electrodes and a barrier rib structure of a plasma display panel.

The PDP in accordance with the fourth embodiment of the present invention includes a pair of sustain electrodes 92 and 93 with a modified pattern from the conventional PDP and thus can be fabricated according to the conventional fabrication process by simply correcting a mask pattern for fabricating a pair of sustain electrodes without any additional process.

As shown in FIG. 8, the PDP includes: a scan electrode 92 formed on the upper glass substrate 43 and formed to correspond to an upper portion of a horizontal barrier rib 80A; a scan electrode 91 formed such that a portion thereof is overlapped with a lower portion of the scan electrode 92; and a common sustain electrode 93 formed on the upper glass substrate 43 and formed to correspond to the upper portion of the horizontal barrier rib 80A.

The scan electrode 92 consists of a transparent electrode 92A formed on the upper glass substrate 43 and a bus electrode 92B formed at a certain portion on the transparent electrode 92A.

The sustain electrode 93 consists of a transparent electrode 93A formed on the upper glass substrate 43 and a bus electrode 93B formed at a certain portion on the transparent electrode 93A and overlapped at an upper portion of the horizontal barrier rib 80A.

The scan electrode 91, formed such that a portion thereof is overlapped at the lower portion of the scan electrode 92, consists of a transparent electrode 91A formed between an upper portion of the barrier rib 80A and a lower portion of the scan electrode 92 and a bus electrode 91B formed at a certain portion on the transparent electrode 91A.

At this time, an electrode gap (G1) of the cell 1 is formed greater than an electrode gap (G2) of the cell 2.

A scan signal for a panel scanning to select horizontal lines formed by a plurality of horizontally adjacent cells and a sustain signal for sustaining discharge are mainly supplied to the scan electrode 92 of the pair of sustain electrodes 92 and 93.

A sustain signal is supplied to the common sustain electrode 83 to sustain the discharge of a selected horizontal line.

The bus electrodes 92B and 93B of the pair of sustain electrodes 92 and 93 are positioned at both marginal portions of a cell and formed of a metal material with a high conductivity, such as silver (Ag) or copper (Cu). The pair of transparent electrodes 92A and 93A of the pair of sustain electrodes 92 and 93 are formed facing each other in the cell region.

The barrier ribs in the lattice type formed to section the cell regions include a horizontal barrier rib 80A formed in a horizontal direction and a vertical barrier rib (not shown) formed in a vertical direction, and as the horizontal barrier rib 80A and the vertical barrier rib 80B are formed intersecting each other, each cell is encompassed by the barrier ribs.

That is, in the PDP in accordance with the fourth embodiment of the present invention, the common sustain electrode 93 and the overlapped scan electrodes 91 and 92 are employed so that the bus electrodes 92B and 93B of the pair of sustain electrodes 92 and 93 are overlapped at the upper portion of the horizontal barrier rib 80A. At this time, the scan electrode 91 is formed between the horizontal barrier rib 81A and the scan electrode 92, and the bus electrode 91B of the scan electrode 91 is formed at a position corresponding to the horizontal barrier rib 81A.

Accordingly, only the transparent electrodes 91A, 92A and 93A with an excellent light transmittance are positioned in one cell.

Therefore, in the PDP in accordance with the fourth embodiment of the present invention, the visible ray interrupted by the bus electrode (metal bus electrode) formed in the cell region in the conventional PDP can be emitted to the image display region. In other words, since no bus electrode is formed in the cell region of the PDP, the visible ray is not interrupted. Consequently, the PDP in accordance with the fourth embodiment of the present invention has improved luminance characteristics.

Especially, the PDP in accordance with the fourth embodiment of the present invention has such improved luminance characteristics for the same power consumption as that of the conventional art. Thus, it accomplishes efficiency characteristics improvement.

In addition, by employing the common sustain electrode like in the conventional art and forming the bus electrode 91B of the scan electrode 91 to be overlapped with the scan electrode 92, such shortcomings that two adjacent cells are shown as one cell as in the conventional PDP which employs a pair of common sustain electrodes can be gotten rid of even without forming the barrier rib thick.

In other words, compared to the conventional PDP in which horizontal barrier ribs are all formed thick, the horizontal barrier rib 80A in the PDP of the present invention does not need to be thick, so that an effective volume of a cell is not reduced and the cell is shown uniform.

Accordingly, in the PDP in accordance with the fourth embodiment of the present invention, a gap G2 of the cell 2 between the electrodes 92 and 93 is formed smaller than a gap G1 of the cell 1 between the electrodes 92 and 93, so that an effective dielectric thickness difference between the electrodes of the cell 1 and the cell 2 is compensated and accordingly a driving voltage of each cell can be the same.

Meanwhile, in the third embodiment of the present invention, as the scan electrodes 81 and 82 are formed by two steps, the thickness of the effective dielectric between the scan electrode 82, the sustain electrode 83 and the address electrode 49 of the cell 1 is formed smaller than the thickness of effective dielectric between the scan electrode 82, the sustain electrode 83 and the address electrode 49 of the cell 2.

That is, the driving voltage of the cell 1 is smaller than that of the cell 2, and since a driving voltage differs for every cell, the PDP becomes uneven, resulting in that a display quality of the PDP and efficiency characteristics are deteriorated.

Therefore, in the PDP in accordance with the fourth embodiment of the present invention, in order to make the effective dielectric thickness between the electrodes to be the same, the gap (G1) between the electrodes of cell 1 is formed greater than the gap (G2) between the electrodes of the cell 2.

In addition, in the PDP in accordance with the fifth embodiment of the present invention, since the barrier rib 80A adjacent to the scan electrode 92 and the common sustain electrode 93 is formed with a minimum thickness as required, an increase in capacitance between the scan electrode 92 and the sustain electrode 93 can be minimized.

In addition, since the bus electrodes 92B and 93B of the scan electrode 92 and the common sustain electrode 93 are formed to be overlapped at the upper portion of the horizontal barrier rib 80A, a phenomenon that the cell is shown uneven is prevented, and thus, a display quality of the PDP can be improved and the increase in the capacitance and the reduction of a cell size can be minimized.

Fifth Embodiment

Figure 9:
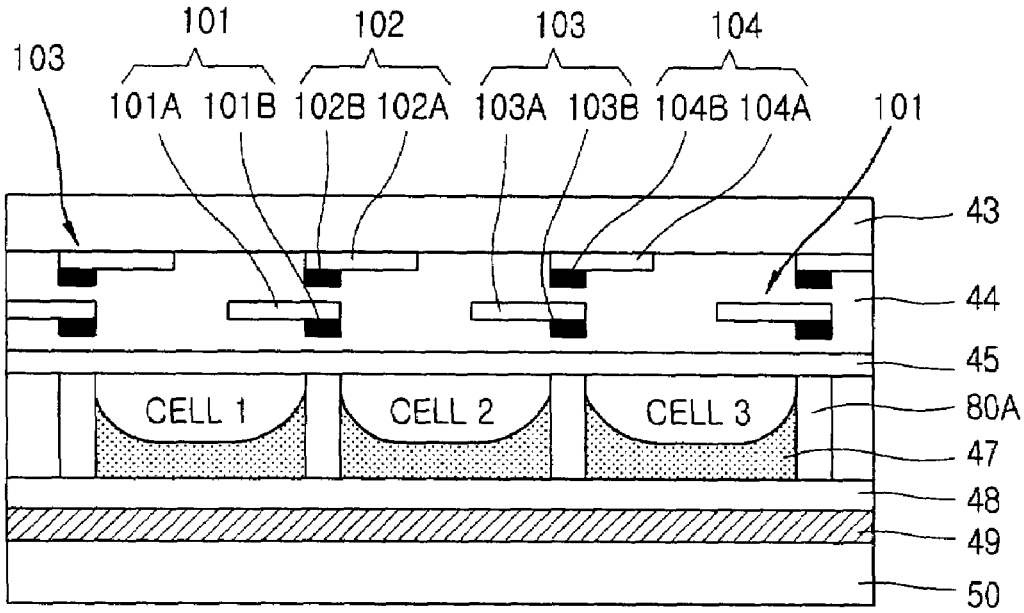
FIG. 9 is a sectional view showing the structure of a PDP in accordance with a fifth embodiment of the present invention.

FIG. 9 is a sectional view showing the structure of a PDP in accordance with a fifth embodiment of the present invention. Specifically, FIG. 9 shows a structure of a pair of sustain electrodes and a barrier rib structure of a plasma display panel.

The PDP in accordance with the fifth embodiment of the present invention includes a pair of sustain electrodes 102 and 103 with a modified pattern from the conventional PDP and thus can be fabricated according to the conventional fabrication process by simply correcting a mask pattern for fabricating a pair of sustain electrodes without any additional process.

As shown in FIG. 9, the PDP in accordance with the fifth embodiment of the present invention includes: a scan electrode 102 formed on the upper glass substrate 43 and formed to correspond to an upper portion of a horizontal barrier rib 80A; a scan electrode 101 formed such that a portion thereof is overlapped with a lower portion of the scan electrode 102; a common sustain electrode 104 formed on the upper glass substrate 43 and formed to correspond to the upper portion of the horizontal barrier rib 80A; and a sustain electrode 103 formed such that a portion thereof is overlapped with a lower portion of the common sustain electrode 104.

The scan electrode 102 consists of a transparent electrode 102A formed on the upper glass substrate 43 and a bus electrode 102B formed at a certain portion on the transparent electrode 102A.

The sustain electrode 104 consists of a transparent electrode 104A formed on the upper glass substrate 43 and a bus electrode 104B formed at a certain portion on the transparent electrode 104A and overlapped at an upper portion of the horizontal barrier rib 80A.

The scan electrode 101, formed such that a portion thereof is overlapped with the lower portion of the scan electrode 102, consists of a transparent electrode 101A formed between an upper portion of the barrier rib 80A and a lower portion of the scan electrode 102 and a bus electrode 101B formed at a certain portion on the transparent electrode 101A.

The sustain electrode 103, formed such that a portion thereof is overlapped with the lower portion of the sustain electrode 104, consists of a transparent electrode 103A formed between an upper portion of the barrier rib 80A and a lower portion of the sustain electrode 102 and a bus electrode 103B formed at a certain portion on the transparent electrode 103A.

That is, the scan electrode 101 is positioned between the scan electrode 102 and the barrier rib 80A, and the sustain electrode 103 is positioned between the sustain electrode 104 and the barrier rib 80A. Thus, all the bus electrodes 101B, 102B, 103B, 104B of the scan electrodes 101 and 102 and the common sustain electrodes 103 and 104 are formed to be overlapped with the horizontal barrier rib 80A.

A scan signal for a panel scanning to select horizontal lines formed by a plurality of horizontally adjacent cells and a sustain signal for sustaining discharge are mainly supplied to the scan electrode 102 of the pair of sustain electrodes 102 and 104.

A sustain signal is mainly supplied to the common sustain electrode 83 to sustain the discharge of a selected horizontal line.

The metal bus electrodes 102B and 104B of the pair of sustain electrodes 102 and 104 are positioned at both marginal portions of a cell and formed of a metal material with a high conductivity, such as silver (Ag) or copper (Cu). The pair of transparent electrodes 102A and 104A of the pair of sustain electrodes 102 and 104 are formed facing each other in the cell region. In addition, the pair of transparent electrodes 101A and 103A of the scan electrode 101 and the sustain electrode 103 are also formed facing each other in the cell region.

The barrier ribs in the lattice type formed to section the cell regions include a horizontal barrier rib 80A formed in a horizontal direction and a vertical barrier rib (not shown) formed in a vertical direction, and as the horizontal barrier rib 80A and the vertical barrier rib 80B are formed intersecting each other, each cell is encompassed by the barrier ribs.

As mentioned above, in the PDP in accordance with the fifth embodiment of the present invention, the overlapped sustain electrodes 103 and 104 and the overlapped scan electrodes 101 and 102 are employed so that all the metal bus electrodes 102B and 104B of the pair of sustain electrodes 102 and 104 are overlapped at the upper portion of the horizontal barrier rib 80A. In addition, all the metal bus electrodes 101B and 103B of the scan electrode 101 and the sustain electrode 103 are formed to be overlapped on the horizontal barrier rib 80A.

Accordingly, only the transparent electrodes 101A, 102A, 103A and 104A with an excellent light transmittance are positioned in one cell.

Therefore, in the PDP in accordance with the fifth embodiment of the present invention, the visible ray interrupted by the bus electrode (metal bus electrode) formed in the cell region in the conventional PDP can be emitted to the image display region. In other words, since no bus electrode is formed in the cell region of the PDP, the visible ray is not interrupted. Consequently, the PDP in accordance with the fifth embodiment of the present invention has improved luminance characteristics.

Especially, the PDP in accordance with the fifth embodiment of the present invention has such improved luminance characteristics fo the same power consumption as that of the conventional art. Thus, it accomplishes efficiency characteristics improvement.

In addition, in the PDP in accordance with the fifth embodiment of the present invention, by forming the metal bus electrodes 102B and 104B of the pair of sustain electrodes 102 and 104 to be overlapped at the upper portion of the horizontal barrier rib 80A, a phenomenon that the cell is shown uneven can be gotten rid of. That is, such shortcomings that two adjacent cells are shown as one cell as in the conventional PDP which employs a pair of common sustain electrodes can be gotten rid of even without forming the barrier rib thick.

For instance, compared to the conventional PDP in which horizontal barrier ribs are all formed thick, the horizontal barrier rib 80A in the PDP of the present invention does not need to be thick, so that an effective volume of a cell is not reduced and the cell is shown uniform.

Accordingly, in the PDP in accordance with the fifth embodiment of the present invention, as each cell has the electrode disposed in the same structure, a driving voltage of each cell is the same to each other.

That is, since the scan electrodes 101 and 102 and the sustain electrodes 103 and 104 are formed by two steps, the thickness of the effective dielectric between the scan electrodes 101 and 102, the sustain electrodes 103 and 104 and the address electrode 49 of the cell 2 is formed to be the same with the effective dielectric thickness between the scan electrodes 101 and 102, the sustain electrodes 103 and 104 and the address electrode 49.

Accordingly, in the PDP in accordance with the fifth embodiment of the present invention, by forming the barrier rib 80A adjacent to the scan electrodes 101 and 102 and the sustain electrodes 103 and 104, with a minimum thickness as required, an increase in capacitance between the scan electrode 102 and the sustain electrode 104 can be minimized.

In addition, since the metal bus electrodes 102B and 104B of the scan electrode 102 and the sustain electrode 104 are formed to be overlapped at the upper portion of the horizontal barrier rib 80A, a phenomenon that the cell is shown uneven is prevented, and thus, a display quality of the PDP can be improved and the increase in the capacitance and the reduction of a cell size can be minimized.

As so far described, the plasma display panel (PDP) of the present invention has many advantages.

That is, for example, first, the metal bus electrode of the PDP is shared by the mutually adjacent discharge cells, so that the common sustain electrodes can be reduced to half in number, and accordingly, its alignment is easy.

Second, since the bus electrode formed in the discharge space of the cell in the plasma display panel and interrupting visible ray is formed to correspond to the upper portion of the barrier rib, the aperture rate is increased and the luminance and efficiency of the PDP are accordingly increased.

Third, since one of the metal bus electrodes of the pair of sustain electrodes positioned in the cell region of the plasma display panel is overlapped at the barrier rib while the other is positioned at the central portion of the cell, such a phenomenon that the cell is shown uneven as in the conventional PDP employing the common sustain electrode can be prevented. That is, visual characteristics of the panel are improved.

Fourth, since the number of metal bus electrodes positioned in one cell is reduced, luminance characteristics of the PDP are improved. In addition, since the luminance characteristics are improved for the same power consumption as that of the conventional PDP, efficiency characteristics are improved.

Fifth, by employing the scan electrodes, the sustain electrode and the common sustain electrodes formed by two steps, such a phenomenon that a cell is shown uneven as in the conventional PDP which employs the common sustain electrode can be prevented, and an increase in capacitance can be minimized.

Lastly, by overlapping the metal bus electrodes formed in one cell on the barrier rib and forming the horizontal barrier rib adjacent to the scan electrode and the sustain electrode with a minimum thickness as required, an increase in capacitance between the scan electrode and the sustain electrode or between the pair of sustain electrodes and the address electrode and a reduction in the cell size can be minimized.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A plasma display panel comprising:

a plurality of discharge cells having a first scan electrode and an address electrode formed intersecting the scan electrode;

a barrier rib for dividing the plurality of discharge cells;

a first sustain electrode formed in a direction of intersecting the address electrode and formed to correspond to an upper portion of the barrier rib; and a second sustain electrode vertically positioned between the first sustain electrode and the barrier rib, wherein the second sustain electrode and the first sustain electrode overlap at an upper portion of the barrier rib.

2. The plasma display panel of claim 1, wherein the barrier rib is formed in a well type.

3. The plasma display panel of claim 1, wherein the first sustain electrode comprises:

a transparent electrode formed on an upper glass substrate; and a metal bus electrode formed at a predetermined portion of the transparent electrode and formed to correspond to an upper portion of the barrier rib.

4. The plasma display panel of claim 3, wherein the metal bus electrode is formed along the central portion of the transparent electrode.

5. The plasma display panel of claim 3, wherein the first scan electrode comprises:

a transparent electrode formed on the upper glass substrate; and a metal bus electrode formed at a predetermined portion of the transparent electrode, wherein the width of the metal bus electrode is half of the width of the transparent electrode.

6. The plasma display panel of claim 5, wherein the transparent electrode of the first scan electrode and the transparent electrode of the first sustain electrode have a plurality of recesses.

7. The plasma display panel of claim 1, wherein a gap between the first scan electrode positioned in one cell of the plurality of discharge cells and a sustain electrode of an adjacent cell is greater than a gap between the first scan electrode and the first sustain electrode positioned in the one cell.

8. The plasma display panel of claim 1, wherein the first scan electrode is positioned with the same height as that of the first sustain electrode.

9. The plasma display panel of claim 1, wherein a gap between the first scan electrode and the first sustain electrode formed in one of the plurality of discharge cells is set to be different from a gap between a scan electrode and a sustain electrode formed in an adjacent cell.

10. The plasma display panel of claim 1, wherein a gap between the first scan electrode and the first sustain electrode formed in one of the plurality of discharge cells is set to be alternately different from a gap between a scan electrode and a sustain electrode formed in an adjacent cell.

11. The plasma display panel of claim 1, wherein the second sustain electrode comprises:

a transparent electrode; and a metal bus electrode formed at a predetermined portion of the transparent electrode.

12. The plasma display panel of claim 11, wherein the metal bus electrode of the second sustain electrode and the metal bus electrode of the first sustain electrode are positioned to correspond to the upper portion of the barrier rib.

13. A plasma display panel device comprising:

a plurality of barrier ribs;

a plurality of discharge cells;

a scan electrode;

a plurality of sustain electrodes formed relative to the barrier ribs; and a different electrode between one of the barrier ribs and one of the sustain electrodes, wherein the different electrode comprises:

a transparent electrode; and a metal bus electrode at a portion of the transparent electrode, wherein the different electrode and the one of the sustain electrodes overlap at an upper portion of the one of the barrier ribs.

14. The plasma display panel of claim 13, further comprising a plurality of electrodes each provided between one of the barrier ribs and one of the plurality of sustain electrodes.

15. The plasma display panel of claim 13, wherein the one of the sustain electrodes comprises:

a transparent electrode on a glass substrate; and a metal bus electrode at a predetermined portion of the transparent electrode and formed to correspond to an upper portion of the one of the barrier ribs.

16. The plasma display panel of claim 15, wherein the metal bus electrode is formed along a central portion of the transparent electrode.

17. The plasma display panel of claim 13, wherein the metal bus electrode of the different electrode is positioned between a metal bus electrode of the one of sustain electrodes and the one of the barrier ribs.

* * * * *